United States Patent [19]

Narancic et al.

[11] 4,320,374

[45] Mar. 16, 1982

[54] ELECTRIC FUSES EMPLOYING COMPOSITE ALUMINUM AND CADMIUM FUSE ELEMENTS

[75] Inventors: Vojislav Narancic, Anjou; Milenko Braunovic, Otterburn Park, both of Canada

[73] Assignee: Kearney-National (Canada) Limited, Guelph, Canada

[21] Appl. No.: 152,230

[22] Filed: May 22, 1980

Related U.S. Application Data

[63] Continuation-in-part of Ser. No. 22,381, Mar. 21, 1979, abandoned.

[51] Int. Cl.[3] ..... H01H 85/12

[52] U.S. Cl. ..... 337/162; 337/293; 337/296

[58] Field of Search ..... 337/158–162, 337/290, 293, 295, 296, 276; 29/623

[56] References Cited

U.S. PATENT DOCUMENTS

| | | | |
|---|---|---|---|
| 1,068,341 | 7/1913 | Hope | 337/296 |
| 2,911,504 | 11/1959 | Cohn | 337/296 |
| 3,256,409 | 6/1966 | Brandt | 337/161 |
| 3,848,214 | 11/1974 | Salzer | 337/158 |

FOREIGN PATENT DOCUMENTS

| | | | |
|---|---|---|---|
| 717681 | 2/1942 | Fed. Rep. of Germany | 337/161 |
| 442357 | 2/1936 | United Kingdom | 337/296 |

*Primary Examiner*—William H. Beha, Jr.
*Attorney, Agent, or Firm*—McCarthy & McCarthy

[57] ABSTRACT

The invention involves new high voltage current limiting fuses employing composite metal fuse elements. One metal of the composite is aluminum which is of high conductivity and high melting point while the other is cadmium which is of low melting point, so that melting of the low melting point metal occurs at any and all locations along the element when its temperature reaches the said low melting point. The resulting composite exhibits properties that are not the mean of the metals employed and has a reversible resistance characteristic thus facilitating the design of the fuse for low current fault interruption.

7 Claims, 7 Drawing Figures

ELECTRIC FUSES EMPLOYING COMPOSITE ALUMINUM AND CADMIUM FUSE ELEMENTS

CROSS-REFERENCE TO RELATED APPLICATION

This application is a continuation-in-part of our application Ser. No: 22,381, filed Mar. 21, 1979, now abandoned in favour of this present application.

FIELD OF THE INVENTION

The present invention is concerned with improvements in or relating to electric fuses employing composite metal fuse elements, and especially to such fuses of high voltage current limiting type.

REVIEW OF THE PRIOR ART

It is known practice to protect an electric circuit by means of two different fuses, one of which is a current limiting fuse that will interrupt fault currents from its maximum interrupting rating to its minimum interrupting rating, and the other of which is a so-called weak link expulsion fuse that will interrupt fault currents a value from slightly above the minimum interrupting current rating of the current limiting fuse. Obviously it is desirable to eliminate the practice of using two fuses, but the design of fuses for interrupting low currents just above (e.g. two times or more) the maximum current rating of the fuse has been a constant problem to the fuse designers, and has added substantially to the complexity, size and cost of the fuses.

Fuse elements for such fuses commonly consist of one or more strips or ribbons of metal mounted in a suitable casing, and the design of such a fuse element requires the careful choice of different parameters among which are the metal from which the element is made, the dimensions of the strip or ribbon, whether or not the strip is notched or provided with eutectic spots (Metcalf effect) along its length; whether or not the element is wound on a ceramic or deionizing gas producing core; whether or not the element consists of two different metals connected in series; and the choice of the material surrounding the element. In a specific example, the ribbon may be of silver and provided along its length with up to about 100 notches, or holes, each of which is the potential site for melting and the initial formation of an arc; the element is completely buried in quartz sand which acts to absorb the energy generated by the arcs, and also to receive the melted element material.

The choice of the metal to be used is always difficult, since each metal usable in commercial practice has its own advantages and disadvantages. For example, silver has a desirable high conductivity and resistance to oxidation, but has a high melting point (960° C.), and a high heat of evaporation and is costly. When spots of tin are soldered along the silver element to make use of the so-called Metcalf or M-effect a eutectic alloy is formed, the melting temperature being lower at the spot (approximately 230° C.) to make the fuse applicable for low current operation, but such spots exhibit with time a non-reversible change under the effect of non-melting current flows that can lead to damage of the fuse. Additionally, while the spot initiates a single melt and subsequent arc at its location, approximately 700° C. greater temperature is required to result in further melting of the silver sufficient to interrupt the high voltage circuit. The added time required for the small overcurrent to produce the much higher element temperature limits the effectiveness of the design.

Cadmium is a low melting point metal (321° C.) with a very low temperature of evaporation (750° C.). It has an excellent arc extinguishing characteristic and therefore it is widely used in electrical contacts. Moreover, it has very high burnback rate and is very convenient for interruption of low currents. Cadmium has low conductivity and current carrying capacity while the resultant cadmium oxide is a very good insulator.

Zinc is a low melting point metal (419° C.) that is resistant to oxidation, has a high burnback rate and has a non-linear coefficient of resistivity, which is useful, but has a conductivity 3–4 times lower than that of silver. Other metals and alloys thereof show some disadvantages when all of the necessary characteristics are evaluated.

Aluminum has a high current capacity and low melting point (658° C.) and the oxide produced is non-conductive, which are all desirable, but the oxide film prevents disbursement of the melted metal into the surrounding sand and the melting characteristic for low currents applied for long times becomes inconsistent.

It is therefore an object of the present invention to provide a new electric fuse employing a new composite material as the fuse element.

In accordance with the present invention there is provided an electric fuse for use in circuits of at least 1000 volts and of the current limiting type comprising:

a tubular housing of insulating material;

two spaced terminals mounted on said housing for connection of the fuse in an electric circuit;

at least one metal fuse element mounted within the housing with the two ends of each element connected respectively to the said two terminals to form a respective conducting path therebetween;

each fuse element being embedded in and surrounded by silica sand disposed within the housing;

characterized in that:

each fuse element comprises a cadmium portion and an aluminum portion, each of which provides a corresponding continuous current carrying path between the said terminals;

each metal being present in the fuse element in an amount not less than 3% by volume of the total;

the said portions being bonded to one another at adjoining contacting surfaces to constitute a composite metal element wherein the cadmium portion due to its lower melting point will melt before the aluminum portion to increase the current density through the unmelted aluminum portion.

DESCRIPTION OF THE DRAWINGS

Particular preferred embodiments of the invention will now be described by way of example, with reference to the accompanying diagrammatic drawings, wherein.

DESCRIPTION

A fuse element for use in an electric fuse of the invention consists of at least two separate metals, each of which is present in the form of at least one so-called separate fuse element portion, and preferably the different fuse element portions are metallurgically bonded to one another at their adjoining surfaces where they contact one another to form in effect a composite metal body.

Figures 1, 2, 3, 4:
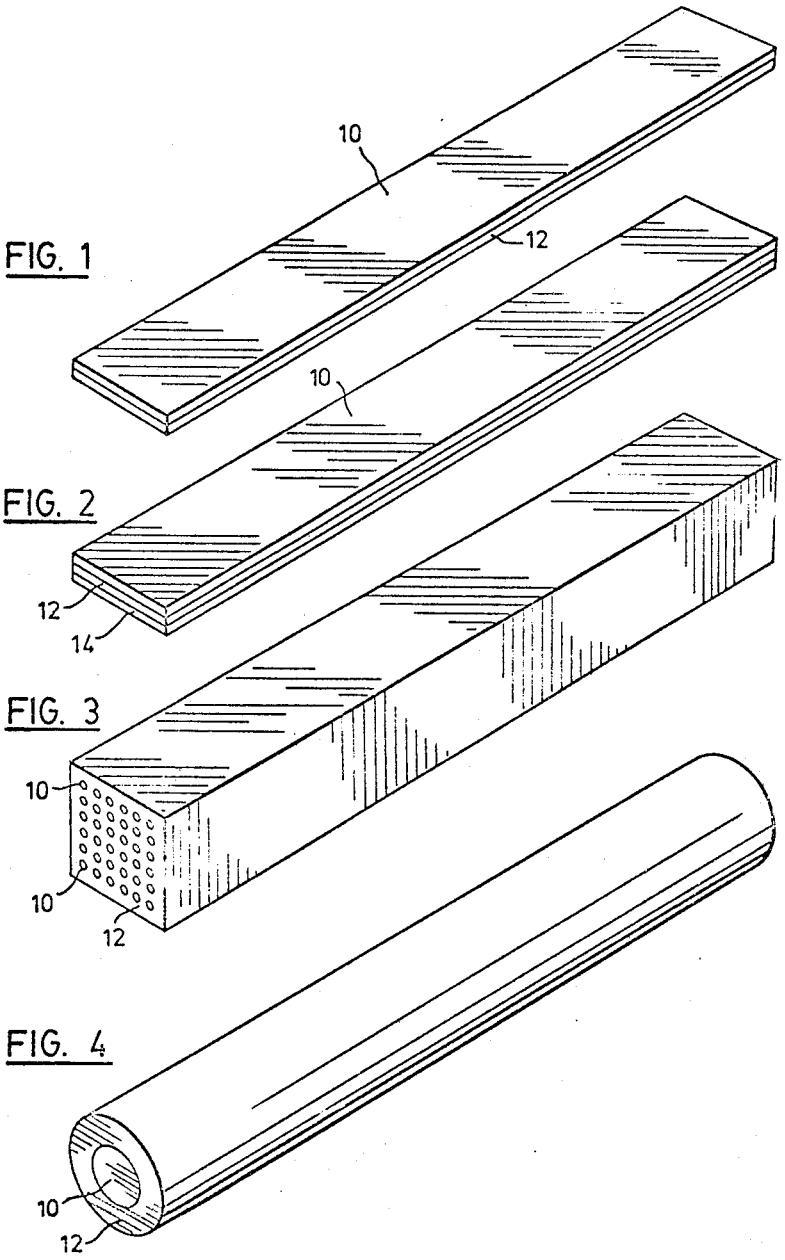
FIGS. 1 to 4 are respective perspective views of preforms from which fuse elements of the invention can be formed.

For example, referring especially to FIG. 1, the fuse element preform illustrated therein consists of two thin flat portions 10 and 12, each of which has the form of a thin flat strip or ribbon having two parallel wider faces and two parallel narrower faces or edges. The two strips are placed face to face and metallurgically bonded to one another by, for example, co-extrusion, cold rolling or by hot rolling at below the melting temperature of the lower melting material. In another method the portion of lower melting temperature metal is formed by casting against the body portion of the higher melting temperature metal, the resulting composite body then being extruded, cold or hot rolled, etc.

In another embodiment illustrated by FIG. 2, more than two separate portions are employed (three in this example); the metal of the portions 10 and 14 can be the same, in which case the portion 12 is sandwiched between two identical other portions, or they can be of different metals. In the embodiment illustrated by FIG. 3 one portion consists of a plurality of uniformly-spaced metal wires or rods 10 which are enclosed in the second body portion 12 by casting the latter metal around them. The resultant rod or wire can then be rolled or extruded as required.

In the embodiment illustrated in FIG. 4 a single body portion 10 is enclosed by the other metal portion 12. The metallurgical bonding of the two body portions at their abutting surfaces is further increased by hot rolling the cast body.

Each of the preforms illustrated is processed, for example, to give it the specific dimensions necessary for fuse elements; notching and mounting the element between a pair of fuse terminals; and embedding the element in a suitable surrounding medium, such as quartz sand, in a suitable container.

Figure 5:
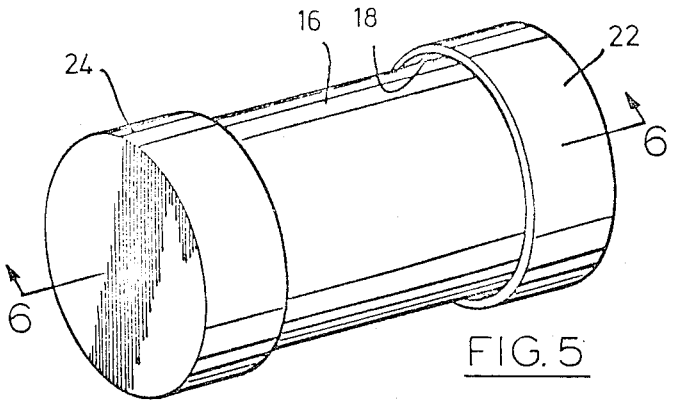
FIG. 5 is a perspective view of one form of fuse constructed according to this invention.
Figure 6:
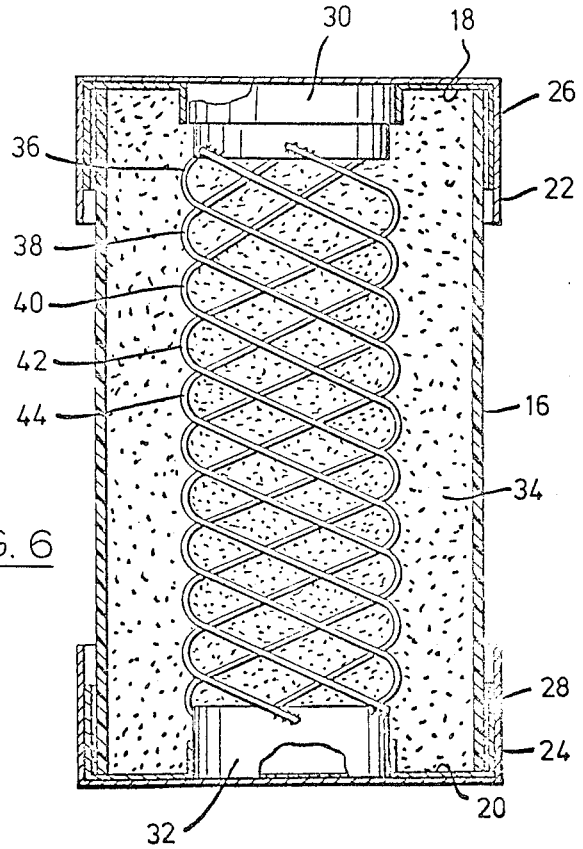
FIG. 6 is a longitudinal cross-sectional view of the structure of FIG. 5, parts thereof being shown broken away as necessary for clarity of illustration.
Figure 7:
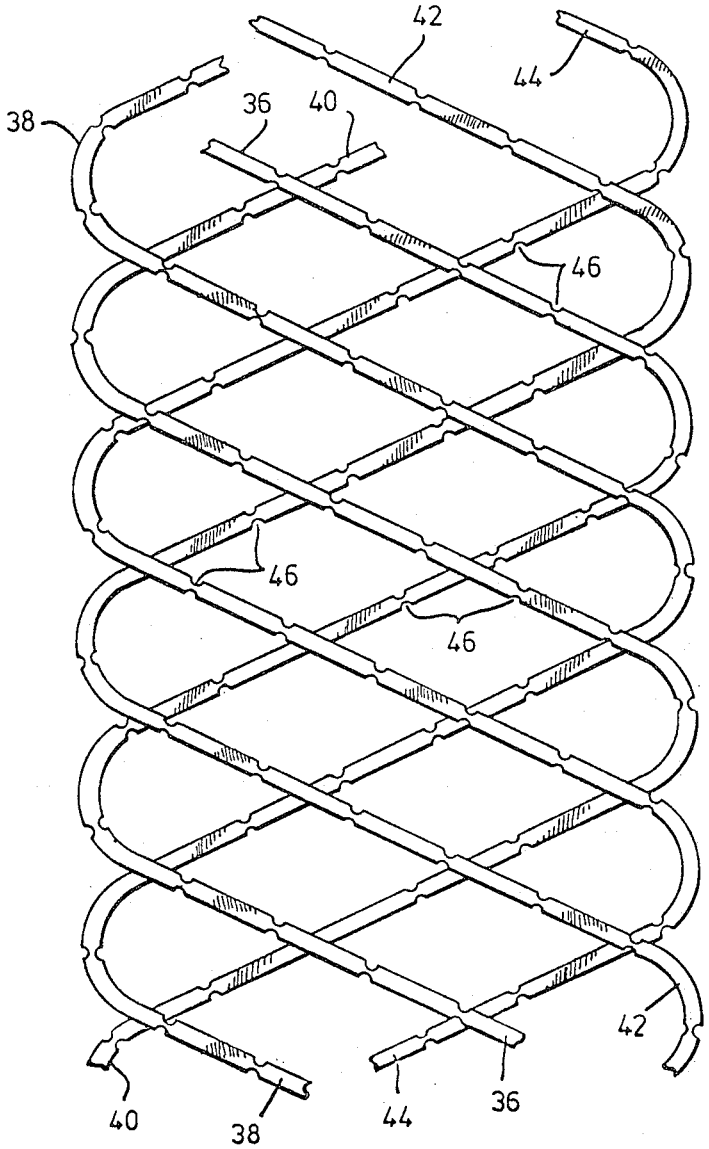
FIG. 7 is an enlarged view depicting the specific details of construction of the fuse elements shown in FIG. 6.

Referring now to FIGS. 5 to 7, there is illustrated therein an electric fuse consisting of a tubular housing 16 of an insulating material, provided with end caps 18 and 20 of a suitable conducting material at each end thereof. Outer caps 22 and 24 are secured about the end caps 18 and 20 respectively by a press fit and are secured to the tubular housing 16 by cement layers 26 and 28 respectively. An end terminal sleeve 30 and an end terminal cap 32 are fastened respectively to the inner surfaces of end caps 18 and 20, and the housing is filled with a granular filler consisting of silica sand 34. Disposed within the housing of the fuse and embedded within and supported by the sand filler are a plurality (5 in this embodiment) of coaxial helical fusible elements 36 through 44, each of which has its two ends connected respectively to the terminal 30 and 32. As is apparent from FIG. 7 the helical fusible elements are each provided along its length with a large number of spaced notches 46. It is found that in meeting the special requirements of a fuse element, the properties of this composite metal element are not simply the mean values for those of the two constituents, but are complex and differ in important respects therefrom. The temperature/time characteristics of the composites of the invention are characterized by two different stages. The initial stage is a normal exponential increase of temperature with time as the fuse is subjected to its normal load current. When an overload is present the temperature of course increases, and upon reaching the melting temperature of the lower melting component, there will be a rapid increase of temperature with time, due to a reduction in the cross sectional area of the element caused by successive melting of the lower temperature component and consequent increase in the current density through the remaining component. This marked increase in characteristic at a specific point permits a more accurate predetermination of the fuse melting characteristic, without this characteristic being unduly affected by aging or pre-melting temperature changes of the fuse element, resulting for example, from current surges passing through it. The temperature/time characteristic of the composite is therefore always reversible up to the temperature at which melting of the lower melting component begins, whereas by comparison the characteristic of a silver element with a tin eutectic spot was found to be irreversible thus leading to eventual damage.

The metals employed in a composite fuse element of the invention are specified as being different as to their electrothermal properties, by which are meant any one or more of their characteristics; resistivity, thermal conductivity, melting point, boiling point, heat of fusion, and heat of evaporation. It will be understood that different metals may have such similar electrothermal properties as not to be suitable for application of the invention. The different portions of the element have as intimate an interface as possible, in order to obtain the best possible electrical and thermal conductivity between the metals without having the undesirable interaction of two metals during the premelting time.

Each metal present in the composite should be present in an amount not less than 3% by volume of the entire element body, since otherwise there will not be sufficient present to significantly affect the properties of the composite. It will be apparent that each metal must be present in the form of a separate body or plurality of bodies that will extend through the intended melt and arc zone of the fuse element in the direction of flow of the current therethrough.

When two metals are employed in the composite one of them will be of high conductivity and high melting point namely aluminum in the preferred combination, while the other is of low melting point, namely cadmium, so that element melting is initiated at any and all locations along the element which reach the melting temperature of the low melting point constituent, starting, of course, at the notches 46. Cadmium oxide that results from the initial melting is a good insulator and therefore does not affect the fuse characteristic and establishes good dielectric strengths so as to assist the arc extinguishing process. It is found that a fuse element of the form illustrated by FIG. 2 is preferred, in which a high melting temperature strip is sandwiched between two low melting temperature strips. It is also found that there is a preferred ratio of width to thickness of each strip, and this should be about 10:1, and may of course vary between say 8:1 and 12:1. An 80 amp fuse as described above will typically employ 12 helical elements connected in parallel each measuring about 2.5 mm by 0.25 mm.

The silica sand filler 34 preferably is in the form of approximately spherical grains of random size within a given range. These grains preferably are composed of at least 99% silica and approximately 98% of the grains are retained on sieve mesh size 100 while approximately 2% of the grains are retained on sieve mesh size 30. Approximately 30% of the grains are retained on sieve mesh size 40 while approximately 75% are retained on sieve mesh size 50. The pellets are identified as 109 G.S.S.

In the event of the occurrence of a high magnitude fault current such as many times rated load current, the fusible elements 36–44 melt practically simultaneously at all of their reduced sections 46 to form a chain of arcs. These arcs quickly lengthen and burn back from their roots. The energy of the arc in the form of heat is absorbed by the filler material in the granular form 34. The exchange of energy between the arcs and the filler material is influenced by the surface area of filler grains which is exposed to the arcs. The greater the area of this exposure the more efficient is the exchange of energy. This factor is facilitated by the use of the filler described and by the fact that the fusible elements are of ribbon form and that they are arranged as multiple elements rather than as one single element, although the invention in its broader aspects is not limited to a fuse using a plurality of parallel connected fuse elements.

Since the invention is concerned with high voltage currents of 1,000 volts and above, it is herein categorized as a high voltage fuse.

A fuse constructed according to this invention is well suited for use in protecting circuits and their connected apparatus such as transformers, capacitors, switchgear and the like. By the invention a fuse is provided which is capable of effective fast acting current limiting action for currents of high magnitude and which also operates reliably for low currents which are but slightly in excess of the normal rated current of the fuse due in part to the fact that the fusible elements may be raised by relatively low fault currents to temperature levels approaching melting without establishing an excessively high overall fuse temperature.

It will also be noted that the preferred illustrated fuse is of coreless design which is to be preferred. In addition to their expense, cores are objectionable because contact with the fusible element reduces the area over which energy exchange between the arcs and the filler material can take place. Since the interrupting process requires that most of the arc energy be transferred to latent heat of fusion of the filler material any reduction of the area of contact with the filler material is undesirable. Moreover, the areas of contact between the elements and core can produce high temperatures in the core. The ceramic material commonly used exhibit marked reduction in their insulating properties at such elevated temperatures. This reduction in insulating property of the core results in a non-uniform voltage distribution across the fuse in the period following arcing.

Under certain transient current conditions, an appreciable temperature rise in the fusible elements may occur and may cause a deformation of the fusible elements. Repeated heating and cooling cycles may impose increasing tensile load on the fusible elements since they may not straighten out due to construction of the sand. If movement of the elements is possible, as in a coreless construction, this tension may be relieved. In elements wound on a core, the opportunity for relieving tension is severely restricted and mechanical failure due to this increased tension may occur, since the increases may be sufficient to break the fusible element, particularly at the reduced cross section notches.

We claim:

1. An electric fuse for use in circuits of at least 1000 volts and of the current limiting type comprising;
- a tubular housing of insulating material;
- two spaced terminals mounted on said housing for connection of the fuse in an electric circuit;
- at least one metal fuse element mounted within the housing with the two ends of each element connected respectively to the said two terminals to form a respective conducting path therebetween;
- each fuse element being embedded in and surrounded by silica sand disposed within the housing;
- characterized in that:
  - each fuse element comprises a cadmium portion and an aluminum portion, each of which provides a corresponding continuous current carrying path between the said terminals;
  - each metal being present in the fuse element in an amount not less than 3% by volume of the total;
  - the said portions being bonded to one another at adjoining contacting surfaces to constitute a composite metal element;
  - wherein the cadmium portion due to its lower melting point will melt before the aluminum portion to increase the current density through the unmelted aluminum portion.

2. An electric fuse as claimed in claim 1,
- characterized in that each fuse element portion is in the form of a single thin flat strip having two wider faces and two narrower faces, and each strip has at least one wider face adjoining and contacting a wider face of the immediately adjacent strip.

3. An electric fuse as claimed in claim 1,
- characterized in that each fuse element portion is in the form of a plurality of thin flat strips, each strip having two wider faces and two narrower faces, and each strip has at least one wider face adjoining and contacting a wider face of the immediately adjacent strip, which is of a different metal.

4. An electric fuse as claimed in claim 2, characterized in that the width to thickness ratio of each strip is in the range 8:1 to 12:1.

5. An electric fuse as claimed in claim 1, characterized in that the aluminum portion is in the form of at least one wire or rod, and the cadmium portion surrounds the said at least one wire or rod and encloses it or them.

6. An electric fuse as claimed in claim 1, characterized in that each fuse element is provided along its length with a plurality of spaced notches to provide respective sites of increased current density and consequent increased temperature.

7. An electric fuse as claimed in claim 1, characterized by a plurality of coaxial helical elements each connected respectively to the said two terminals.

* * * * *